United States Patent [19]

Etzbach et al.

[11] Patent Number: 4,760,049

[45] Date of Patent: Jul. 26, 1988

[54] DYE TRANSFER

[75] Inventors: Karl-Heinz Etzbach, Frankenthal; Ruediger Sens, Mannheim, both of Fed. Rep. of Germany

[73] Assignee: BASF Aktiengesellschaft, Rheinland-Pfalz, Fed. Rep. of Germany

[21] Appl. No.: 113,909

[22] Filed: Oct. 29, 1987

[30] Foreign Application Priority Data

Nov. 13, 1986 [DE] Fed. Rep. of Germany ..... 3638756

[51] Int. Cl.[4] ..... B41M 5/034; B41M 5/26

[52] U.S. Cl. ..... 503/227; 8/471; 427/146; 427/256; 428/175; 428/913; 428/914

[58] Field of Search ..... 8/471; 428/913, 914, 428/195; 503/227; 427/146, 256

[56] References Cited

U.S. PATENT DOCUMENTS 4,698,651 10/1987 Moore et al. ..... 8/471

FOREIGN PATENT DOCUMENTS 60-031564 2/1985 Japan ..... 503/227

*Primary Examiner*—Bruce H. Hess

*Attorney, Agent, or Firm*—Oblon, Fisher, Spivak, McClelland & Maier

[57] ABSTRACT

Dyes are transferred from a substrate to a plastics-coated paper by sublimation or vaporization using a thermal printing head by using a substrate of which there are dyes of the formula where $R^1$, $R^2$, $R^3$, $R^4$ and $R^5$ each have defined meanings.

2 Claims, No Drawings

DYE TRANSFER

The present invention relates to a novel process for transferring a cyanovinyl dye from a substrate to a plastics-coated paper by sublimation or vaporization using a thermal printing head.

In the sublimation transfer process, a transfer sheet which contains on a substrate a sublimable dye with or without a binder is heated from the back with a heater head in short pulses (lasting a fraction of a second), and the dye sublimes or vaporizes and transfers to a receiving medium. The significant advantage of this process is that control of the amount of dye to be transferred (and hence of the anchoradation of color) is easily possible by adjusting the energy supply to the heater head.

Color recording is in general effected using the three subtractive primaries yellow, magenta and cyan (with or without black). For optimal color recording, the dyes used will have the following properties:

easy sublimability or vaporizability (which requirement is in general most difficult to meet with the cyan dyes);

high thermal and photochemical stability and resistance to moisture and chemicals;

suitable hues for subtractive color mixing;

a high molecular absorption coefficient;

easy industrial accessibility.

Most of the known dyes used for thermal transfer printing, however, do not meet these requirements to a sufficient degree.

The prior art discloses dyes for this purpose. For instance, JP-A-No. 229,786/1985 describes dicyano- and tricyanovinyl dyes where the dicyano- or tricyanovinyl group is bonded to a dialkylaminophenyl radical.

It is an object of the present invention to provide a process for transferring a dye which should be easily sublimable or vaporizable under the application conditions of a thermal printing head, should not undergo thermal or photochemical decomposition, be processible into a printing ink and meet the coloristic requirements. In addition, the dye should be industrially easily accessible.

We have found that this object is achieved by using a substrate on which there is a dye of the formula I

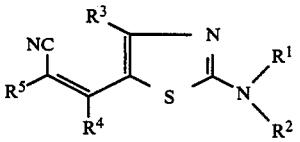

(I)

where $R^1$ and $R^2$ are identical or different and each, independently of the other, is hydrogen, $C_1$–$C_4$-alkyl which may be substituted by fluorine, chlorine, bromine or $C_1$–$C_4$-alkoxy, $C_2$–$C_4$-alkenyl, benzyl, phenyl, cyclohexyl or together with the nitrogen atom a five- or six-membered saturated heterocyclic radical, $R^3$ is hydrogen, $C_1$–$C_4$-alkyl, benzyl, phenyl, $C_1$–$C_6$-alkoxyphenyl, $C_1$–$C_4$-dialkylaminophenyl, halogen or unsubstituted or $C_1$–$C_4$-alkyl-, fluorine-, chlorine- or bromine-substituted furyl or thienyl, $R^4$ is hydrogen or cyano and $R^5$ is cyano or $COOR^6$ where $R^6$ is $C_1$–$C_4$-alkyl which may be substituted by fluorine, chlorine, bromine, hydroxyl, $C_1$–$C_4$-alkoxy, $C_5$–$C_7$-cycloalkyl or phenyl, or $C_5$–$C_7$-cycloalkyl.

$R^1$ and $R^2$ in the formula I are for example, hydrogen, methyl, ethyl, propyl, isopropyl, butyl, isobutyl, sec-butyl, tert-butyl, fluoromethyl, chloromethyl, difluoromethyl, trifluoromethyl, 2-fluoroethyl, 2-chloroethyl, 2-bromoethyl, pentafluoroethyl, 2-chloro-1,1,2,2-tetrafluoroethyl, nonafluorobutyl, 2-methoxyethyl, 2-ethoxyethyl, 2-propoxyethyl, 2-isopropoxyethyl, 2-butoxyethyl, 2-sec-butoxyethyl, 2-methoxypropyl, 1-methoxyprop-2-yl, 2-methoxybutyl, 2-ethoxybutyl, 4-methoxybutyl, 4-isopropoxybutyl, ethenyl, prop-2-en-1-yl, but-2-en-1-yl, 2-methylprop-2-en-1-yl, phenyl, benzyl or cyclohexyl.

$R^1$ and $R^2$ in the formula I, together with the nitrogen atom are in addition for example the following heterocyclic radicals: pyrrolidino, piperidino, morpholino, N-methylpiperazino, N-ethylpiperazino, N-propylpiperazino, N-isopropylpiperazino, N-butylpiperazino, N-isobutylpiperazino or N-sec-butylpiperazino.

$R^3$ in the formula I is for example hydrogen, methyl, ethyl, propyl, isopropyl, butyl, isobutyl, sec-butyl, tert-butyl, benzyl, phenyl, 2-methoxyphenyl, 4-methoxyphenyl, 2-ethoxyphenyl, 4-ethoxyphenyl, 4-propoxyphenyl, 4-isopropoxyphenyl, 4-butoxyphenyl, 4-isobutoxyphenyl, 4-sec-butoxyphenyl, 4-tert-butoxyphenyl, 4-pentyloxyphenyl, 4-isopentyloxyphenyl, 4-hexyloxyphenyl, 2-dimethylaminophenyl, 4-dimethylaminophenyl, 4-diethylaminophenyl, 4-dipropylaminophenyl, 4-diisopropylaminophenyl, 4-dibutylaminophenyl, 4-(N-methyl-N-ethylamino)phenyl, fluorine, chlorine, bromine, fur-2-yl, 5-methylfur-2-yl, 5-ethylfur-2-yl, 5-propylfur-2-yl, 5-isopropylfur-2-yl, 5-butylfur-2-yl, 2,5-dimethylfur-3-yl, 2,4,5-trimethylfur3-yl, 5-fluorofur-2-yl, 5-chlorofur-2-yl, 5-bromofur-2-yl, thien-2-yl, 5-methylthien-2-yl, 5-ethylthien-2-yl, 5-propylthien-2-yl, 2,5-dimethylthien-3-yl, 5-fluorothien-2-yl, 5-chlorothien-2-yl or 5-bromothien-2-yl.

$R^4$ in the formula I is hydrogen or cyano.

$R^5$ in the formula I is for example, cyano, methoxycarbonyl, ethoxycarbonyl, propoxycarbonyl, isopropoxycarbonyl, butoxycarbonyl, sec-butoxycarbonyl, tertbutoxycarbonyl, fluoromethoxycarbonyl, chloromethoxycarbonyl, difluoromethoxycarbonyl, trifluoromethoxycarbonyl, 2-fluoroethoxycarbonyl, 2-chloroethoxycarbonyl, 2-bromo-ethoxycarbonyl, pentafluoroethoxycarbonyl, 2-chloro-1,1,2,2-tetrafluoroethoxycarbonyl, nonafluorobutoxycarbonyl, 2-hydroxyethoxycarbonyl, 2-hydroxypropoxycarbonyl, 3-hydroxypropoxycarbonyl, 2-hydroxybutoxycarbonyl, 4-hydroxybutoxycarbonyl, 2-methoxyethoxycarbonyl, 2-ethoxyethoxycarbonyl, 2-propoxyethoxycarbonyl, 2-isopropoyethoxycarbonyl, 2-butoxyethoxycarbonyl, 2-sec-butoxyethoxycarbonyl, 2-methoxypropoxycarbonyl, 3-methoxypropoxycarbonyl, 1-methoxyprop-2-oxycarbonyl, 2-methoxybutoxycarbonyl, 2-ethoxybutoxycarbonyl, 4-methoxybutoxycarbonyl, 4-isopropoxybutoxycarbonyl, cyclopentylmethoxycarbonyl, cyclohexylmethoxycarbonyl, cycloheptylmethoxycarbonyl, 2-cyclohexylethoxycarbonyl, benzyloxycarbonyl, 2-phenylethoxycarbonyl, cyclopentyloxycarbonyl, cyclohexyloxycarbonyl or cycloheptyloxycarbonyl.

Preferably, the process according to the invention is carried out by using a substrate on which there is a dye of the formula I in which $R^1$ and $R^2$ are independently of each other hydrogen, $C_1$–$C_4$-alkyl, benzyl, phenyl or together with the nitrogen atom a five- or six-membered saturated heterocyclic radical, and $R^3$ is hydrogen, $C_1$–$C_4$-alkyl, benzyl, phenyl, 4-($C_1$–$C_4$-alkoxy)phenyl, 4-($C_1$–$C_4$-dialkylamino)phenyl or unsubstituted or methyl- or chlorine-substituted furyl or thienyl.

The dye of the formula I is known per se and can be obtained in a conventional manner.

For instance, the dye of the formula I where $R^4$ is hydrogen is obtained for example by subjecting a corresponding thiazole which is unsubstituted in the 5position on the ring to a Vilsmayer formylation and reacting the resulting 5-formylthiazole with malonitrile or a corresponding cyanoacetic ester.

Further methods of preparation are described in DE-A-No. 3,227,329 and Ann. Chem. 250 (1889), 265.

The tricyanovinyl dye ($R^4$=cyano) was prepared similarly to the method described in J. Amer. Chem. Soc. 80 (1958), 2806, by reacting the corresponding thiazole derivative with tetracyanoethylene.

Compared to the dyes used in existing processes, the dye transferred in the process according to the invention is generally more sublimable, more lightfast, more resistant to chemicals and less resublimed from the paper.

To produce the dye substrate required for the process, the dye is processed in a suitable solvent, for example chlorobenzene or isobutenol, with a binder into a printing ink, in which the dye is present in dissolved or dispersed form. The printing ink is knife-coated onto an inert substrate, and the coat of ink is dried in air.

Suitable binders are for example ethylcellulose, polysulfones and polyether sulfones. Inert substrates are for example tissue paper, blotting paper, parchment paper and plastics films of high heat resistance, for example possibly metal-coated polyester, polyamide or polyimide. The thickness of the substrate preferably ranges from 3 to 30 μm. Further substrates, binders and printing ink solvents suitable for the process according to the invention are described in DE-A-No. 3,524,519.

Suitable dye receptor layers are in principle all thermostable plastics layers which have an affinity for the transfer dye, for example polyester.

The transfer is effected by means of a thermal printing head of sufficient heating power to transfer the dye within a few milliseconds.

The invention is illustrated in more detail by the following examples:

To be able to test the transfer behavior of a dye quantitatively and simply, the thermotransfer was carried using a large-area hot press instead of a thermal printing head. In addition, the dye substrate test specimens were prepared without a binder.

(A) General formulation for coating the substrate with dye:

1 g of ethylene glycol, 1 g of a dispersant based on a condensation product of phenol, formaldehyde and sodium hydrogensulfite, 7.5 g of water and 0.5 g of a dye of the formula I are introduced together with 10 g of glass balls (2 mm in diameter) into a vessel, and the vessel is sealed and shaken on a shaker (Red Devil®) until the average particle size of the dye is $<1$ μm (duration: from 8 to 12 hours, depending on the dye). The glass balls are sieved off, the dye dispersion thus obtained, which may be diluted with water to twice the volume, is coated with a 6 μm doctor blade onto paper, and the coat is dried in the air.

(B) Testing of sublimation or vaporization behavior

The (donor) paper coated with the dye under test is placed with the side where the dye layer is onto an 80 μm thick polyester film (receptor) and pressed down. Donor/receptor are then wrapped with aluminum foil and heated for 30 seconds between two hot plates. The amount of dye which has migrated into the polyester film is determined photometrically.

A plot of the logarithm of the absorbance A measured at various temperatures within the range of from 100° to 200° C. of the dyed polyester films against the inverse of the corresponding absolute temperature is a straight line from whose slope the activation energy $\Delta E_T$ for the transfer experiment is calculated:

$$\Delta E_T = 2.3 \cdot R \cdot \frac{\Delta \log A}{\Delta\left(\frac{1}{T}\right)}$$

To complete the characterization, the plot additionally reveals the temperature T* [° C] where the absorbance A of the dyed polyester film attains the value 1.

Table 1 below indicates dyes of the formula

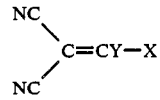

which were processed in accordance with (A) and tested in substrates coated in accordance with (B) in respect of sublimation properties. The table gives in each case the resulting hue and also the thermotransfer parameters T* and $\Delta E_T$.

TABLE 1

| Dye | X | Y | Hue | T*[°C.] | $\Delta E_T \left[\frac{kcal}{mol}\right]$ |
|---|---|---|---|---|---|
| 1 | 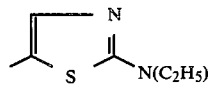 | H | yellow | 152 | 25 |
| 2 | 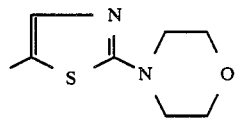 | H | yellow | 155 | 24 |

TABLE 1-continued
| Dye | X | Y | Hue | T*[°C.] | $\Delta E_T \left[\frac{kcal}{mol}\right]$ |
|---|---|---|---|---|---|
| 3 | 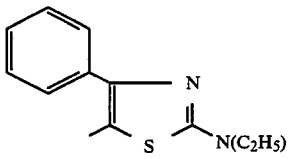 | H | yellow | 158 | 21 |
| 4 | 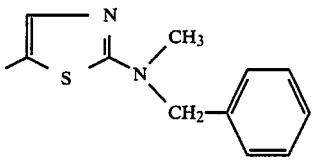 | H | yellow | 144 | 16 |
| 5 | 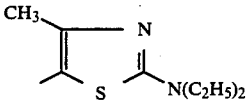 | H | yellow | 137 | 22 |
| 6 | 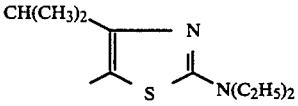 | H | yellow | 151 | 22 |
| 7 | 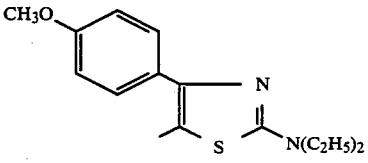 | H | yellowish orange | 167 | 31 |
| 8 | 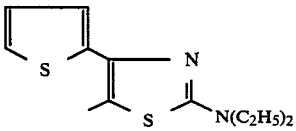 | H | orange | 159 | 20 |
| 9 | 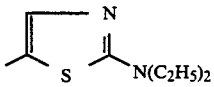 | CN | yellowish brown | 132 | 24 |
| 10 | 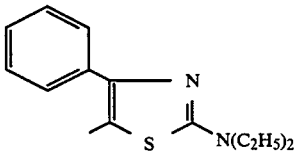 | CN | red | 183 | 29 |
| 11 | 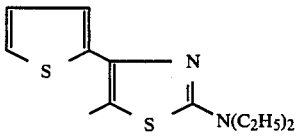 | CN | bluish red | 170 | 20 |
| 12 | 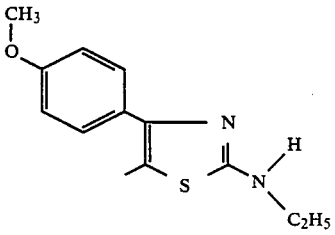 | H | yellow | 167 | 31 |

TABLE 1-continued
| Dye | X | Y | Hue | T*[°C.] | $\Delta E_T \left[\frac{kcal}{mol}\right]$ |
|---|---|---|---|---|---|
| 13 | 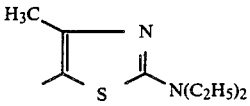 | H | yellow | 137 | 22 |
The same method was used to transfer the dyes of the formula
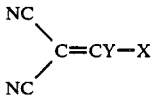
mentioned in Table 2.
TABLE 2
| Dye | X | Y | Hue |
|---|---|---|---|
| 14 | 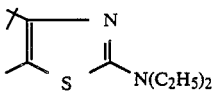 | H | yellow |
| 15 | 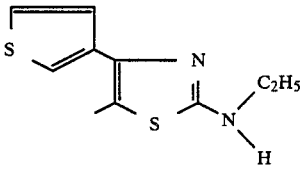 | H | yellow |
| 16 | 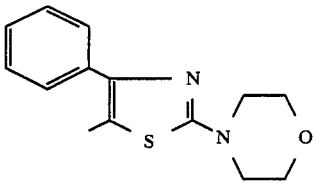 | H | yellow |
| 17 | 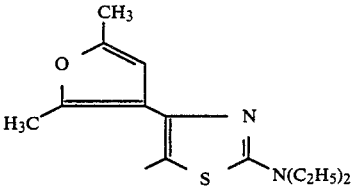 | H | yellow |
| 18 | 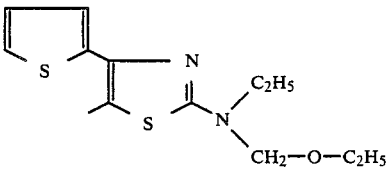 | H | yellow |
| 19 | 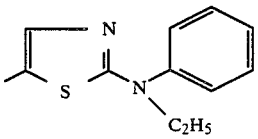 | H | yellow |

TABLE 2-continued
| Dye | X | Y | Hue |
|---|---|---|---|
| 20 | 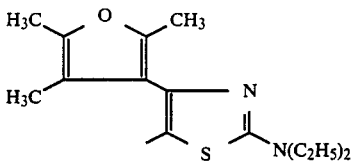 | CN | red |
| 21 | 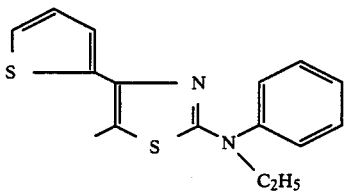 | CN | reddish violet |
| 22 | 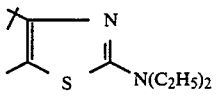 | CN | reddish violet |
| 23 | 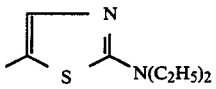 | $COOCH_3$ | yellow |
| 24 | 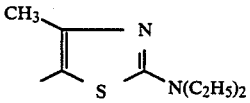 | $COOC_2H_5$ | yellow |
| 25 | 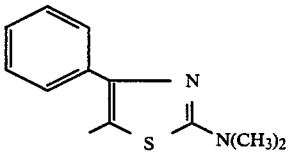 | $COOCH_3$ | yellow |
| 26 | 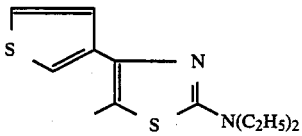 | $COOCH_3$ | yellow |
| 27 | 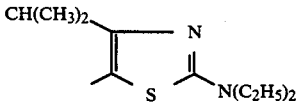 | $COOCH(CH_3)_2$ | yellow |
| 28 | 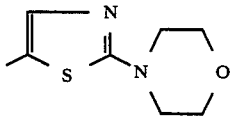 | $COOCH_3$ | yellow |
| 29 | 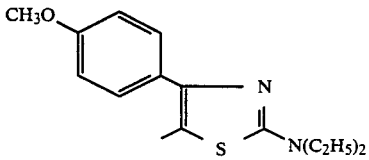 | $COOC_2H_5$ | yellow |

TABLE 2-continued

| Dye | X | Y | Hue |
|---|---|---|---|
| 30 | 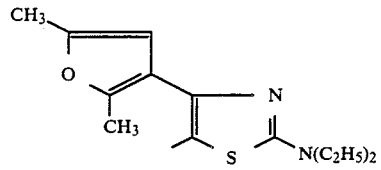 | $COOCH_3$ | yellow |
| 31 | 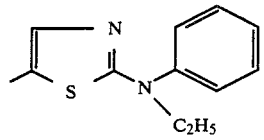 | $COOCH_3$ | yellow |
| 32 | 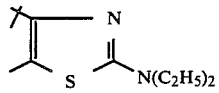 | $COOCH_3$ | yellow |

We claim:

1. A process for transferring a dye from a substrate to a plastics-coated paper by sublimation or vaporization using a thermal printing head, which comprises using a substrate on which there is a dye of the formula I

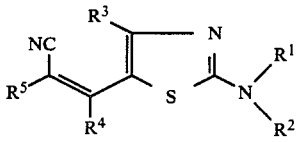

(I)

where $R^1$ and $R^2$ are identical or different and each, independently of the other, is hydrogen, $C_1$–$C_4$-alkyl which may be substituted by fluorine, chlorine, bromine or $C_1$–$C_4$-alkoxy, $C_2$–$C_4$-alkenyl, benzyl, phenyl, cyclohexyl or together with the nitrogen atom a five-or six-membered saturated heterocyclic radical, $R^3$ is hydrogen, $C_1$–$C_4$-alkyl, benzyl, phenyl, $C_1$–$C_6$-alkoxyphenyl, $C_1$–$C_4$-dialkylaminophenyl, halogen or unsubstituted or $C_1$–$C_4$-alkyl-, fluorine-, chlorine-or bromine-substituted furyl or thienyl, $R^4$ is hydrogen or cyano and $R^5$ is cyano or $COOR^6$ where $R^6$ is $C_1$–$C_4$-alkyl which may be substituted by fluorine, chlorine, bormine, hydroxyl, $C_1$–$C_4$-alkoxy, $C_5$–$C_7$-cycloalkyl or phenyl, or $C_5$–$C_7$-cycloalkyl.

2. A proces as claimed in claim 1, wherein $R^1$ and $R^2$ are independently of each other hydrogen, $C_1$–$C_4$-alkyl, benzyl, phenyl or together with the nitrogen atom a five- or six-membered saturated heterocyclic radical, and $R^3$ is hydrogen, $C_1$–$C_4$-alkyl, benzyl, phenyl, 4-($C_1$–$C_4$-alkoxy)phenyl, 4-($C_1$–$C_4$-dialkylamino)phenyl or unsubstituted or methyl- or chlorine-substituted furyl or thienyl.

* * * * *